US008640300B2

(12) United States Patent
Gent

(10) Patent No.: US 8,640,300 B2
(45) Date of Patent: Feb. 4, 2014

(54) COLLECTION OF RECYCLABLE OR WASTE MATERIAL

(75) Inventor: Steven Gent, Devon (GB)

(73) Assignee: Recresco Limited, Nottinghamshire (GB)

( * ) Notice: Subject to any disclaimer, the term of this patent is extended or adjusted under 35 U.S.C. 154(b) by 402 days.

(21) Appl. No.: 12/710,564

(22) Filed: Feb. 23, 2010

(65) Prior Publication Data

US 2010/0215444 A1 Aug. 26, 2010

(30) Foreign Application Priority Data

Feb. 24, 2009 (GB) ..... 0903039.6

(51) Int. Cl.
*A47L 5/06* (2006.01)

(52) U.S. Cl.
USPC ..... 15/340.1; 15/342

(58) Field of Classification Search
USPC ..... 15/340.1, 340, 3, 314, 341; 406/96, 102
See application file for complete search history.

(56) References Cited

U.S. PATENT DOCUMENTS

| | | | | | |
|---|---|---|---|---|---|
| 3,407,432 | A | * | 10/1968 | Finn | 15/352 |
| 3,588,179 | A | * | 6/1971 | Oscar | 406/40 |
| 3,665,545 | A | * | 5/1972 | Beekman | 15/314 |
| 3,778,865 | A | * | 12/1973 | Schmidt et al. | 15/359 |
| 3,995,754 | A | | 12/1976 | DeKoning | |
| 4,019,219 | A | * | 4/1977 | Willenborg | 15/339 |
| 4,200,950 | A | | 5/1980 | Coverley | |
| 4,356,589 | A | | 11/1982 | Mealing et al. | |
| 5,317,783 | A | * | 6/1994 | Williamson | 15/346 |
| 5,558,284 | A | | 9/1996 | Baumung et al. | |
| 5,718,017 | A | | 2/1998 | Pavlick | |
| 6,003,195 | A | * | 12/1999 | Whitney | 15/314 |
| 2006/0059652 | A1 | * | 3/2006 | Vry | 15/340.1 |

FOREIGN PATENT DOCUMENTS

| | | | |
|---|---|---|---|
| DE | 4331191 | A1 | 3/1995 |
| EP | 0509165 | A1 | 10/1992 |
| EP | 1125868 | A1 | 8/2001 |
| FR | 2697510 | A1 | 5/1994 |
| FR | 2707963 | A1 | 1/1995 |
| GB | 314255 | | 6/1929 |
| GB | 2388061 | A | 11/2003 |
| GB | 2461604 | A | 1/2010 |
| KR | 20020085162 | A | 11/2002 |

OTHER PUBLICATIONS

Janiak Manufacturing, Inc., Specifications Giant-Vac Model 6500-TR14 Municipal Leaf Loader, Rev Aug. 2005.

Giant Vac Parts, Fan Impeller Model 6800, Copyright 2006, Cyncon Equipment Inc.

Giant-Vac 6600-JD-CM (Chassis Mount), 80HP, 4-Cylinder, John Deere Water-Cooled Diesel Engine, Aug. 2005.

* cited by examiner

*Primary Examiner* — Dung Van Nguyen
(74) *Attorney, Agent, or Firm* — Young Basile

(57) ABSTRACT

Disclosed herein are Apparatus for the collection of recyclable or waste material. The apparatus comprises a movable element for drawing ambient air into the apparatus through an inlet, in use, thereby creating a suction force that draws the recyclable or waste material into the apparatus through the inlet. The apparatus is arranged such that material drawn into the apparatus impacts the movable element, and the apparatus further comprises a compactor for reducing the volume occupied by the recyclable or waste material.

17 Claims, 4 Drawing Sheets

COLLECTION OF RECYCLABLE OR WASTE MATERIAL

FIELD OF THE INVENTION

This invention relates to the collection of recyclable or waste material, and in particular to apparatus for the collection of recyclable or waste material, and collection vehicles including such apparatus.

BACKGROUND

The generation of waste is a great burden to society and infrastructure, made ever worse by the gradual increase in the world's population. Governments are being required to manage all types of waste, particularly domestic waste, in an efficient and effective manner that is sustainable over the long term. As part of the strategy to tackle this waste burden, many governments have turned to recycling to reduce the amount of waste being sent to landfill sites.

An important step in the management of waste is its collection. In many countries, a number of schemes are already in place for the collection of recyclable or waste material from public storage containers and/or household storage containers. In particular, community recycling centres are provided in many countries, which contain large, public storage containers allocated for different types of material (such as glass, plastic or paper). In addition, commercial premises are commonly provided with large storage containers for recyclable material. The storage containers themselves may be adapted to be transported to local processing plants. Alternatively, the recyclable material may be transferred manually from these storage containers to conventional collection vehicles, which then transport the recyclable material to local processing plants.

The problems associated with these schemes for the collection of recyclable material include the difficulty of efficiently collecting and then transporting the recyclable material to the relevant processing plant. In particular, where the storage containers themselves are adapted to be transported to local processing plants, the size of the storage containers is limited, and hence the number of collection trips is increased. Furthermore, where the recyclable material is transferred manually from the storage containers to conventional collection vehicles, which then transport the recyclable material to local processing plants, this manual transfer of material is inefficient and labour intensive.

SUMMARY

There has now been developed apparatus for the collection of recyclable or waste material, which overcomes or substantially mitigates the above-mentioned and/or other disadvantages associated with the prior art.

According to a first aspect of the invention there is provided apparatus for the collection of recyclable or waste material, the apparatus comprising a movable element for drawing ambient air into the apparatus through an inlet, in use, thereby creating a suction force that draws the recyclable or waste material into the apparatus through the inlet, the apparatus being arranged such that material drawn into the apparatus impacts the movable element, and the apparatus further comprising a compactor for reducing the volume occupied by the recyclable or waste material.

According to a further aspect of the invention there is provided a method of collecting recyclable or waste material, which method comprises the steps of (a) providing an apparatus as described above; (b) operating the movable element to create a suction force that draws the recyclable or waste material into the apparatus through the inlet, such that the material impacts the movable element; and (c) operating the compactor to reduce the volume occupied by the recyclable or waste material.

The apparatus and method according to the invention are advantageous principally because the recyclable or waste material is drawn into the apparatus through the inlet by a suction force generated by the movable element, the recyclable or waste material subsequently impacts the movable element, which preferably damages the material, and finally the volume occupied by the material is reduced by the compactor. The apparatus therefore enables recyclable or waste material to be efficiently collected from a storage container, and then significantly reduced in volume ready for transportation. The invention therefore removes any need for manually transferring the recyclable or waste material from a storage container to a collection vehicle, and also significantly reduces the volume occupied by the material within the collection vehicle, thereby enabling a greater amount of material to be collected and transported by a particular size of collection vehicle.

The apparatus according to the invention may be adapted for the collection of any type of recyclable or waste material, such as domestic or commercial waste, but is particularly advantageous in relation to the collection of plastics waste or recyclable material.

The apparatus can be adapted to damage at least some of the material that impacts the movable element, in use, in order to facilitate the reduction of the volume occupied by the recyclable or waste material by the compactor. In particular, the damage that is caused by the movable element, in use, is preferably sufficient to improve the reduction in volume of the recyclable or waste material achievable by the compactor. The damage that is caused by the movable element, in use, may include weakening and/or rupture of at least some of the items of the recyclable or waste material that impacts the movable element.

The damage that is caused by the movable element, in use, can be sufficient to improve the reduction in volume of the recyclable material achievable by the compactor by at least 10%, or by at least 20% or by at least 30%. In these embodiments, the apparatus can be adapted to damage at least 10% of the items of waste or recyclable material drawn through the inlet of the apparatus, or at least 20% or at least 30%.

In embodiments herein, the apparatus according to the invention is specifically adapted for the collection of plastics waste or recyclable material, and in particular plastic vessels, e.g. bottles. In these embodiments, the apparatus is preferably adapted such that the impact with the movable element sufficiently weakens and/or ruptures at least some of the plastic vessels, such that plastic vessels that would otherwise not be compactable by the compactor of the apparatus, for example sealed plastics vessels containing liquid and/or air, are sufficiently damaged by the movable element for those plastics vessels to be compactable by the compactor. For example, the apparatus is preferably adapted such that the impact with the movable element weakens and/or ruptures the areas of the plastics vessels that have the greatest thickness, for example at the base and/or collar of plastic bottles. Most preferably, the plastic vessels remain in one piece.

It has been found that using conventional apparatus for the collection of plastics recyclable or waste material, approximately 10% of plastics bottles cannot be compacted by a conventional compactor and will withstand a pressure of 40 tonnes without reducing in size. Furthermore, it has been found that a compacted plastics bottle occupies approximately 10% of the volume of a plastics bottle that has not been compacted. Hence, in conventional apparatus for the collection of plastics recyclable or waste material, approximately 50% of the volume of collected plastic bottles is comprised of 10% of the plastic bottles collected.

The movable element can be rotatable, and in particular the movable element can comprise a rotatable support and one or more projections mounted thereon. The rotatable support can be generally circular or conical in shape, and the one or more projections can have the form of blades. In particular, the one or more blades can be orientated generally radially on the support. In embodiments herein, the movable element has the form of an impeller, in that it urges air outwardly from its axis of rotation, thereby generating an area of reduced pressure that draws air towards the movable element, along its axis of rotation. This action of the movable element preferably creates a suction force that draws the recyclable or waste material into the apparatus through its inlet, during use.

In embodiments herein, in order to achieve a desired damage of plastics vessels, as discussed above, the movable element can be rotated at a speed of between 1000 and 6000 rpm, or between 2000 and 5000 rpm or between 3000 and 4000 rpm.

The movable element can be mounted within a housing, and can be adapted to transfer air from an inlet of the housing to an outlet of the housing. The inlet of the housing can be in communication with the inlet of the apparatus, and the outlet of the housing can be in communication with the compactor. The apparatus can be therefore arranged to generate air flow from the inlet of the apparatus to the compactor. Furthermore, the apparatus can be adapted such that recyclable or waste material is entrained in this airflow, and hence is transferred from the inlet of the apparatus to the compactor.

The inlet of the apparatus can be a tubular conduit, which leads to the movable element. The inlet of the apparatus may be fixed, but may include at least a flexible end portion including an entrance to the inlet, and hence enables the entrance to the inlet to be readily manipulated by a user. In particular, the inlet can be adapted to be engaged with, or inserted through, an entrance of a storage container for recyclable or waste material. For convenience, in embodiments herein, the inlet comprises an inner fixed portion that leads to the movable element, and an outer flexible portion that is releasably fixable to the inner fixed portion.

Where the movable element is rotatable, the housing for the movable element can comprise a chamber within which the movable element is disposed, and an inlet through which the material drawn into the apparatus passes immediately before it impacts the movable element. The chamber can be generally cylindrical in shape, with the inlet formed in one end of the generally cylindrical chamber. The outlet of the housing can be orientated along an axis that is generally orthogonal to the axis of rotation of the movable element, and most preferably generally tangential relative to the movable element, such that the direction of flow of air and entrained material exiting the housing is preferably generally orthogonal to the axis of rotation of the movable element, and preferably also the direction of flow of air and entrained material into the housing through the inlet.

In embodiments herein, the central axis of the inlet of the housing, along which air and entrained material flows into the housing, in use, is substantially parallel to the axis of rotation of the movable element. In addition, the central axis of the inlet of the housing is preferably off-set from the axis of rotation of the movable element, most preferably in a direction away from the outlet of the housing. It has been found that this feature may reduce the risk that the material drawn into the apparatus will cause an obstruction within the housing. In particular, the distance between the central axis of the inlet of the housing and the outlet of the housing is preferably greater than the distance between the axis of rotation of the movable element and the outlet of the housing. Furthermore, the inlet of the housing preferably has a greater dimension in an axis that is parallel to the direction of flow through the outlet of the housing, relative to its dimension in an axis that is perpendicular to the direction of flow through the outlet of the housing. Most preferably, the inlet of the housing is generally elliptical in shape.

The movable element is preferably fixedly mounted about a rotatable shaft, which preferably extends through an opening in the housing of the movable element, most preferably in the opposite wall of the housing from the inlet. The rotatable shaft is preferably rotatably mounted to a shaft support, most preferably by at least two bearing units.

The movable element and its housing can be adapted to enable the transfer of recyclable or waste material between the inlet and the outlet of the housing, whilst being sufficiently resistant to material fouling upon the movable element, which would necessitate manual removal of the fouled material. In this regard, where the apparatus is intended for use with domestic recyclable material, and the movable element comprises a rotatable support having a number of blades mounted thereon, it has been found that the preferred number of blades is between three and five blades, and most preferably four blades.

The movable element can be adapted to be sufficiently resistant to the impact of recyclable or waste material, in use, to ensure an acceptable lifetime of the movable element. The movable element can be therefore formed of a material of sufficient strength, such as steel.

Furthermore, where the movable element comprises a rotatable support having a number of blades mounted thereon, it has been found that providing the rotatable support with a raised portion on which an inner portion of each blade is mounted, improves the resistance of the movable element to the impact of recyclable or waste material, in use. The raised portion is preferably conical or pyramidal in form, with the remainder of the rotatable support preferably having the form of a circular plate.

Each blade can include a stay for supporting the blade, which can extend between the blade and the rotatable support. The stays are preferably disposed on the trailing surfaces of the blades, with respect to the direction of rotation. Each blade can have the form of a plate, which can decrease in height relative to the rotatable support, as the blade extends towards the centre of the movable element. Each stay can have the form of a plate, and is generally triangular in form.

The movable element can be resiliently mounted relative to the remainder of the apparatus, in order to improve its resistance to the impact of recyclable or waste material, in use. In particular, the movable element is movable away from a rest position, but is biased by the resilient mounting to return to its rest position.

Where the movable element is fixedly mounted about a rotatable shaft, and the rotatable shaft is rotatably mounted to a shaft support, the shaft support is preferably mounted on one or more resilient members, thereby resiliently mounting the movable element relative to the remainder of the apparatus. In presently preferred embodiments, the shaft support comprises at least two bearing units within which the shaft is mounted, and the at least two bearing units are preferably mounted on a common support. In these embodiments, the common support is preferably mounted on one or more resilient members. The resilient members may be formed of rubber or an elastomeric material, or may have the form of a conventional metal spring.

The compactor of the apparatus is preferably adapted to receive recyclable or waste material that has been drawn into the apparatus by the movable element, and which has impacted the movable element. The compactor preferably therefore includes a receiving hopper adapted to receive recyclable or waste material following impaction by the movable element. In presently preferred embodiments, the outlet of the housing of the movable element is adapted to direct recyclable or waste material into the receiving hopper of the compactor.

The compactor is preferably adapted to transfer the recyclable or waste material to a storage container of the apparatus, and hence reduce the volume occupied by the recyclable or waste material within that storage container. The compactor of the apparatus preferably has the form of a conventional compactor for domestic recyclable or waste material. In particular, the compactor preferably comprises a compacting member, such as a slidable plate, adapted to transfer recyclable or waste material from the receiving hopper into the storage container of the apparatus, and compact that material within the storage container. The compacting member is preferably driven by one or more hydraulic rams.

The apparatus according to the invention is preferably incorporated into a vehicle adapted to collect and transport recyclable or waste material, ie a collection vehicle for recyclable or waste material. Hence, according to a further aspect of the invention, there is provided a collection vehicle for recyclable or waste material comprising apparatus as described above. In these embodiments, the movable element and the compactor are preferably driven by the engine of the vehicle, most preferably using a power take-off (PTO) mechanism.

The collection vehicle according to the invention may be manufactured in a form that includes the apparatus described above. However, retro-fitting apparatus may be provided to convert conventional collection vehicles that comprise a compactor for reducing the volume occupied by the recyclable or waste material within the collection vehicle.

Hence, according to a further aspect of the invention, there is provided apparatus adapted to be retro-fitted to a collection vehicle for recyclable or waste material, which collection vehicle comprises a compactor for reducing the volume occupied by the recyclable or waste material within the collection vehicle, the retro-fitted apparatus comprising a movable element for drawing ambient air into the collection vehicle through the inlet, thereby creating a suction force that draws the recyclable or waste material into the collection vehicle through the inlet, the device being arranged such that material drawn into the vehicle impacts the movable element.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
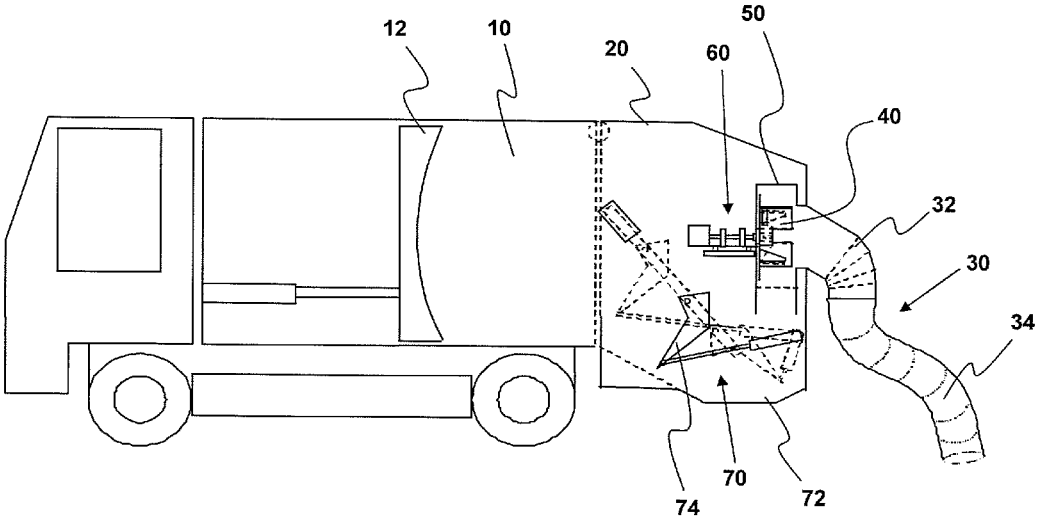
FIG. 1 is a schematic side view, showing hidden detail, of an embodiment of a collection vehicle according to the invention.

FIG. 1 shows a collection vehicle according to the invention, which comprises a storage container 10 and rear-mounted apparatus for collecting recyclable or waste material. The apparatus for collecting recyclable or waste material comprises an apparatus housing 20, an inlet 30, an impactor 40, an impactor housing 50, an impactor mounting 60 and a compactor 70.

The storage container 10, the apparatus housing 20 and the compactor 70 are of the type found in conventional vehicles for the collection of domestic recyclable or waste material. However, in contrast to their usual arrangement in conventional collection vehicles, the apparatus housing 20 is closed, and hence does not allow ready access by a user to the compactor 70, for example, save for the inlet 30 and a small inspection hatch (not shown in the Figures).

The inlet 30 is a tubular conduit, comprising a fixed inner portion 32 formed of steel, and a flexible outer portion 34 formed of polypropylene, each with a diameter of approximately 0.3 m. The fixed inner portion 32 extends from an aperture in a rear wall of the apparatus housing 30, initially at an angle of approximately 45° to horizontal, but terminating in a short vertical end. The flexible outer portion 34 is releasably connected at one end to the fixed inner portion 32, and at the other end has an entrance through which recyclable or waste material is collected. This entrance to the inlet 30 is adapted to be manipulated by a user, for example to be inserted into, or engaged with, an entrance of a storage container for recyclable or waste material. The flexible outer portion 34 is adapted to be stowed on the vehicle when not in use.

Figure 2:
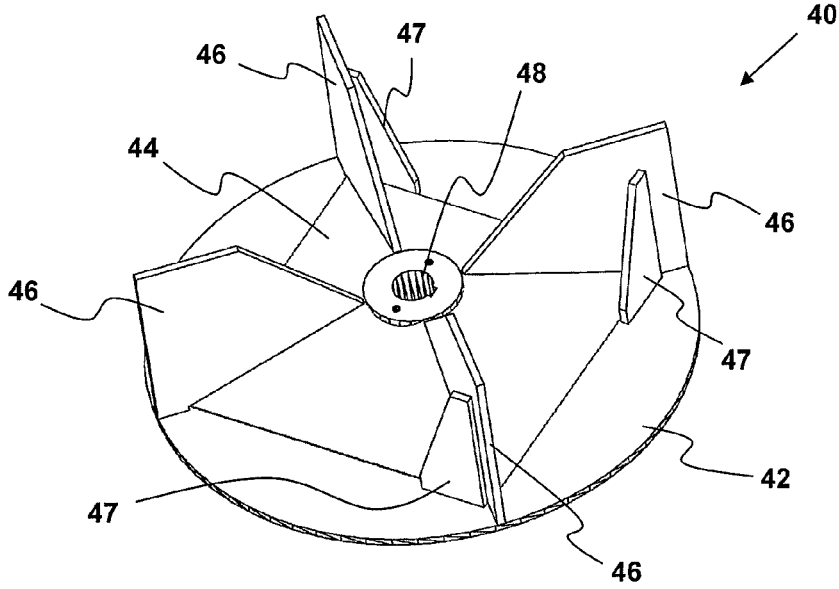
FIG. 2 is a perspective view, showing hidden detail, of an impactor that forms part of the collection vehicle of FIG. 1.

The impactor 40 is shown most clearly in FIG. 2. The impactor 40 comprises a circular support plate 42, a four-sided pyramidal formation 44 formed centrally on the support plate 42, and four impactor blades 46. In addition, a central, cylindrical bore 48 extends through the centre of the support plate 42 and the pyramidal formation 44.

The impactor blades 46 extend along the inclined edges of the pyramidal formation 44, and hence radially relative to the circular support plate 42, and each blade 46 is orientated parallel to the axis of rotation of the impactor 40. Each blade 46 comprises an outer portion of relatively constant height relative to the circular support plate 42, and an inner portion of gradually reducing height towards the centre of the impactor 40. Each blade 46 is also provided with a stay 47, which is generally triangular in form and is formed on the trailing surface of each blade 46. Each stay 47 has the form of a plate, and is orientated along the adjacent edge of the pyramidal formation 44.

Figure 3:
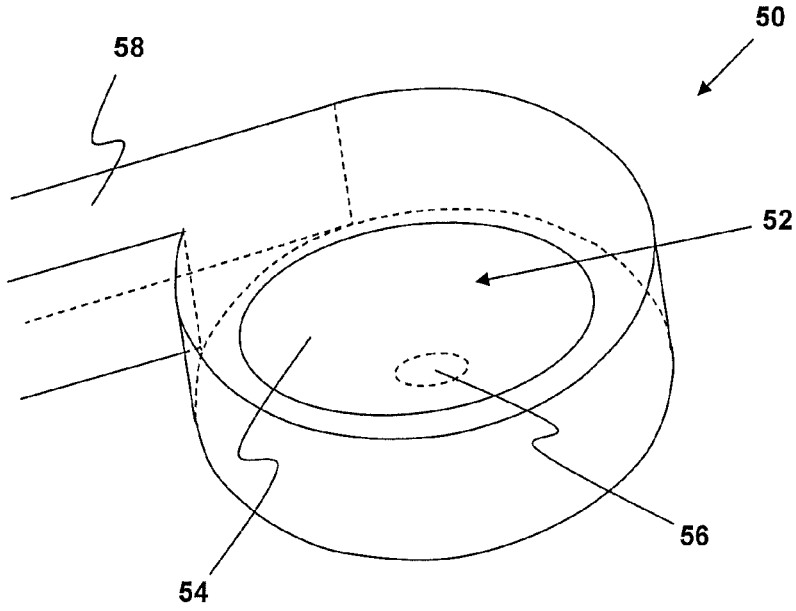
FIG. 3 is a perspective view, showing hidden detail, of an impactor housing that forms part of the collection vehicle of FIG. 1.

The impactor 40 is housed within the impactor housing 50, which is formed in 4 mm steel and is shown most clearly in FIG. 3. In particular, the impactor housing 50 comprises a cylindrical chamber 52, which has one end in which an elliptical inlet 54 is formed. This inlet 54 to the impactor housing 50 is connected to the tubular inlet 30 of the collecting apparatus, as shown clearly in FIG. 1. At the other end of the cylindrical chamber 52 is a smaller, central opening 56, through which the impactor shaft 62 extends (see FIG. 5). The impactor housing 50 also includes an outlet 58, which is a box-section conduit extending tangentially from a side wall of the housing 50. This outlet 58 is oriented generally vertically in the apparatus housing 20, and leads to the compactor 70 of the apparatus, as shown in FIG. 1.

Figure 4:
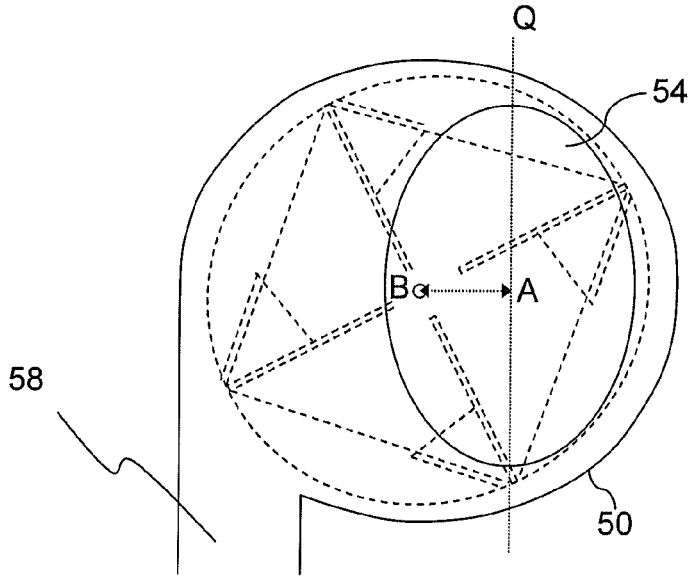
FIG. 4 is a front view of the impactor housing, showing hidden detail.

As shown most clearly in FIG. 4, the inlet 54 to the impactor housing 50 is elliptical in shape, with its major axis (Q) arranged parallel to the direction of flow of air and entrained material through the outlet 58 of the housing 50, and perpendicular to the axis of rotation (B) of the impactor 40. In addition, the centre (A) of the inlet 54 to the impactor housing 50 is off-set from the axis of rotation (B) of the impactor 40, in a direction perpendicularly away from the outlet 58 of the housing 50. It has been found that this arrangement of the inlet 54 to the impactor housing 50 reduces the risk that material entering the housing 50 causes an obstruction during use.

Figure 5:
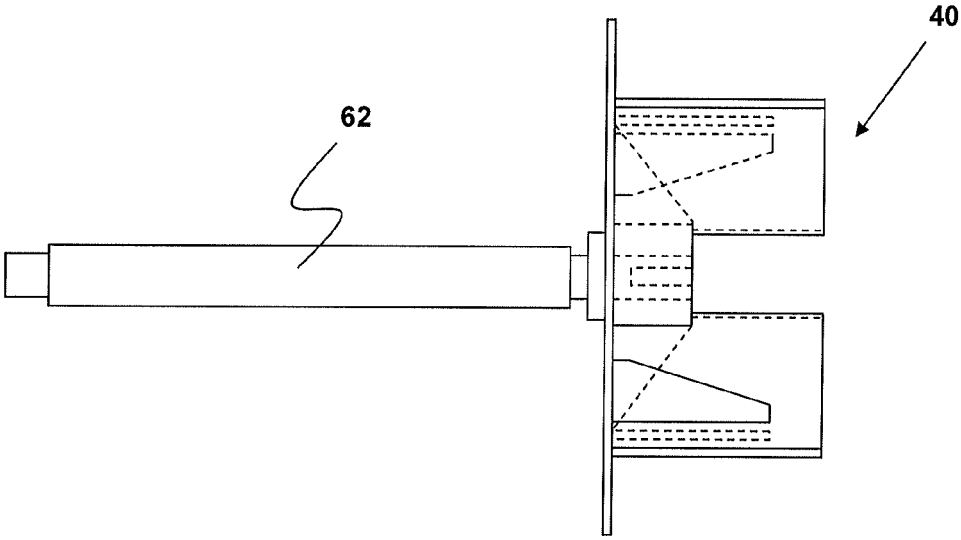
FIG. 5 is a side view, showing hidden detail, of the impactor and an impactor shaft on which the impactor is mounted.

As shown in FIG. 5, the impactor 40 is mounted on an impactor shaft 62. The impactor shaft 62 is fixed to the impactor 40 at one end, in particular being fixed within the central, cylindrical bore 48 of the impactor 40. The other end of the impactor shaft 62 is connected to a drive mechanism (not shown in the Figures). The drive mechanism for the impactor shaft 62 and impactor 40 is a power take-off (PTO) mechanism, which is adapted to be run at 600-750 rpm, to produce a rotation of the impactor shaft 62 and impactor 40 at 3500-3700 rpm. This rotational speed has been found to damage domestic plastics recyclable material. The vehicle is also provided with an emergency cut-off switch, which is mounted adjacent to the rear inspection hatch (not shown in the Figures).

Figure 6:
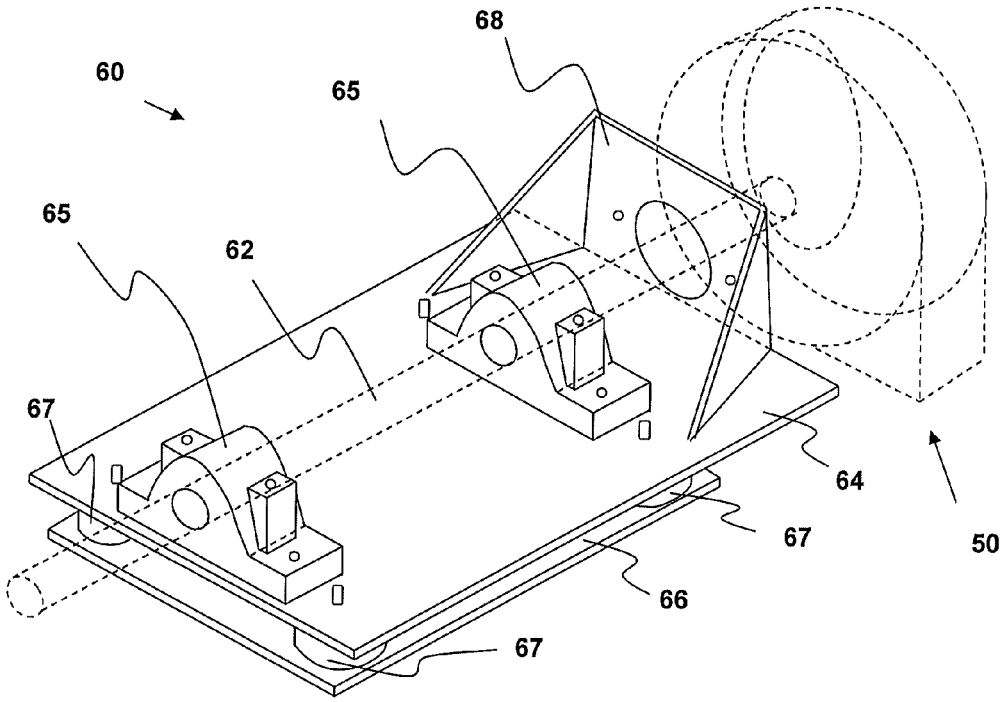
FIG. 6 is a perspective view of an impactor shaft mounting, the impactor and impactor shaft being shown schematically in broken lines.

As shown most clearly in FIG. 6, the impactor shaft 62 is mounted between its ends to a support plate 64, by means of two bearing units 65. The support plate 64 is in turn resiliently mounted to a platform 66 by four resilient mounts 67 formed of rubber, one at each corner of the platform 66. The platform 66 is fixed to the apparatus housing 20. The impactor mounting 60 also includes a guard 68 mounted at one end of the support plate 64, between the bearing units 65 and the impactor housing 50, with an opening through which the impactor shaft 62 extends.

Referring now to FIG. 1, the compactor 70 comprises a receiving hopper 72 for receiving recyclable or waste material from the outlet 58 of the impactor housing 50, and a slidable and pivotable compacting member 74 for transferring that material to the storage container 10, and compacting the material therein. The storage container 10 also includes a movable end wall 12 that enables the compacted recyclable and waste material to be ejected from the storage container 10, once the apparatus for collecting the recyclable and waste material has been moved, or removed, from the rear of the vehicle.

In use, the vehicle is driven to a storage container, such as a public storage container for domestic recyclable material (not shown in the Figures). Once situated adjacent to the storage container, the flexible outer portion 34 of the inlet 30 is attached to the fixed inner portion 32, and the inlet 30 is then connected by a user to the entrance of the storage container. The power take-off (PTO) mechanism to the impactor shaft 62 and impactor 40 is then activated and run by the engine at 600-750 rpm, to produce a rotation of the impactor shaft 62 and impactor 40 at 3500-3700 rpm. This rotation of the impactor 40 generates a suction force at the inlet 30.

This suction force causes recyclable material to be drawn from the storage container, along the inlet 30, and into the impactor housing 50. In the impactor housing 50, the recyclable material impacts the impactor 40, which causes damage to the majority of the recyclable material. The recyclable material is forced by the impactor 40 through the outlet 58 of the impactor housing 50, and falls into the receiving hopper 72 of the compactor 70.

The compacting member 74 is operated periodically to transfer the recyclable material within the receiving hopper 72 to the storage container 10 of the vehicle, and compact the recyclable material within the storage container 10. Once the storage container 10 of the vehicle is fully charged, the vehicle is driven to a recyclable material processing plant, where the recyclable material is deposited.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A recyclable material collection apparatus comprising:

a conduit having an inlet configured for engagement with a storage container of recyclable material and an exit opposite the inlet;

a movable element configured to create a suction force to draw ambient air through the inlet, thereby drawing the recyclable material through the conduit, the movable element having a rotatable support plate with a plurality of blades mounted thereon, the movable element positioned in a housing in communication with the exit of the conduit, the movable element positioned in relation to the exit of the conduit so that the recyclable material contacts the plurality of blades which are configured to weaken the recyclable material upon impact, wherein the movable element is resiliently mounted within the housing with a resilient mounting configured so that the movable element is movable away from an at-rest position in the housing by impact with the recyclable material but is biased to return to the at-rest position by the resilient mounting; and a compactor for reducing a volume occupied by the recyclable material after weakening.

2. The apparatus as claimed in claim 1, wherein the rotatable support plate has a raised portion with inclined edges extending there from, with each blade is mounted on an inclined edge such that each blade extends radially relative to the rotatable support plate.

3. The apparatus as claimed in claim 1, wherein the movable element is configured to transfer air from an inlet of the housing to which the exit of the conduit engages through an outlet of the housing, the outlet of the housing having a central axis that is generally orthogonal to an axis of rotation of the movable element, and a central axis of the inlet of the housing being substantially parallel to the axis of rotation of the movable element.

4. The apparatus as claimed in claim 3, wherein the central axis of the inlet of the housing is off-set from the axis of rotation of the movable element, in a direction away from the outlet of the housing.

5. The apparatus as claimed in claim 1, wherein the apparatus is mounted to a recyclable material collection vehicle.

6. The apparatus as claimed in claim 1, wherein the moveable element is configured to rotate at a speed of between 2000 and 5000 rotations per minute.

7. The apparatus as claimed in claim 1, wherein each of the plurality of blades includes a stay extending between the blade and the rotatable support.

8. The apparatus as claimed in claim 1, wherein the movable element is fixedly mounted about a rotatable shaft and the rotatable shaft is supported by at least two bearing units.

9. An apparatus adapted to be retro-fitted to a recyclable material collection vehicle having a compactor for reducing a volume occupied by the recyclable material within the collection vehicle, the retro-fitted apparatus comprising:

a conduit having an inlet configured to be engaged with a storage container of recyclable material and an exit in communication with a housing; and a movable element resiliently mounted within the housing and configured to create a suction force to draw ambient air through the inlet, thereby drawing the recyclable material through the conduit, the movable element having a rotatable support plate with a plurality of blades mounted thereon and positioned in relation to the exit of the conduit so that the recyclable material contacts the plurality of blades configured to weaken the recyclable material upon impact, wherein the movable element is mounted to the housing with a resilient mounting configured so that the movable element is movable away from an at-rest position in the housing by impact with the recyclable material but is biased to return to the at-rest position by the resilient mounting.

10. The apparatus as claimed in claim 9, wherein the rotatable support plate has a raised portion with inclined edges extending there from on which an inner portion of each blade is mounted such that each blade is radially mounted with respect to the rotatable support plate.

11. The apparatus as claimed in claim 9, wherein the housing comprises an inlet and the outlet of the housing has a central axis that is generally orthogonal to an axis of rotation of the movable element, and a central axis of the inlet of the housing being substantially parallel to the axis of rotation of the movable element.

12. The apparatus as claimed in claim 1, wherein the central axis of the inlet of the housing is off-set from the axis of rotation of the movable element, in a direction away from the outlet of the housing.

13. A method of collecting recyclable material from a storage container comprising:

(a) engaging an inlet of a conduit with a storage container for recyclable material;

(b) creating a suction force with a movable element to draw the recyclable material through the conduit by drawing ambient air through the inlet, wherein an exit of the conduit is connected to a housing and positioned such that the recyclable material impacts the movable element;

(c) weakening the recyclable material through impact with the movable element, wherein the movable element has a rotatable support plate with a plurality of blades mounted thereon and is mounted to the housing with a resilient mounting configured so that the movable element is movable away from an at-rest position in the housing by impact with the recyclable material but is biased to return to the at-rest position by the resilient mounting; and (d) operating a compactor to reduce a volume of the recyclable material after weakening.

14. The method as claimed in claim 13, wherein the storage container is a public storage container for domestic recyclable material.

15. The method as claimed in claim 13, wherein the recyclable material being collected comprises plastic vessels.

16. The method as claimed in claim 15, wherein the moveable element is operated such that closed plastic vessels that contain fluid and would otherwise not be compactable by the compactor are weakened by the movable element such that the fluid is released from the plastics vessels to be compactable by the compactor.

17. The method as claimed in claim 13, wherein the movable element is rotated at a speed of between 1000 and 6000 rpm.

* * * * *